US007589694B2

(12) United States Patent
Martek et al.

(10) Patent No.: US 7,589,694 B2
(45) Date of Patent: Sep. 15, 2009

(54) SMALL, NARROW PROFILE MULTIBAND ANTENNA

(75) Inventors: Gary A. Martek, Blythewood, SC (US); Leon Fulmer, Prosperity, SC (US); John Maynard, Columbia, SC (US); Henry Jarman, Newberry, SC (US)

(73) Assignee: Shakespeare Company, LLC, Columbia, SC (US)

( * ) Notice: Subject to any disclaimer, the term of this patent is extended or adjusted under 35 U.S.C. 154(b) by 22 days.

(21) Appl. No.: 11/784,007

(22) Filed: Apr. 5, 2007

(65) Prior Publication Data

US 2008/0246679 A1 Oct. 9, 2008

(51) Int. Cl.
*H01Q 1/36* (2006.01)
*H01Q 9/28* (2006.01)
*H01Q 9/38* (2006.01)

(52) U.S. Cl. ..... 343/895; 343/795; 343/830

(58) Field of Classification Search ..... 343/700 MS, 343/725, 791, 795, 872, 895, 793, 797, 810–820, 343/846, 830

See application file for complete search history.

(56) References Cited

U.S. PATENT DOCUMENTS

| | | | | |
|---|---|---|---|---|
| 4,800,395 | A * | 1/1989 | Balzano et al. | 343/895 |
| 5,293,175 | A * | 3/1994 | Hemmie et al. | 343/795 |
| 5,650,792 | A | 7/1997 | Moore et al. | 343/725 |
| 5,859,621 | A | 1/1999 | Leisten | 343/895 |
| 5,969,689 | A * | 10/1999 | Martek et al. | 343/758 |
| 6,018,324 | A | 1/2000 | Kitchener | 343/795 |
| 6,259,416 | B1 | 7/2001 | Qi et al. | 343/767 |
| 6,377,227 | B1 | 4/2002 | Zhu et al. | 343/795 |
| 6,483,471 | B1 * | 11/2002 | Petros | 343/725 |
| 6,525,694 | B2 | 2/2003 | Jiang et al. | 343/742 |
| 6,784,850 | B2 * | 8/2004 | Morooka et al. | 343/895 |
| 6,879,296 | B2 | 4/2005 | Jiang et al. | 343/767 |
| 7,050,014 | B1 | 5/2006 | Chen et al. | 343/795 |
| 7,154,442 | B2 * | 12/2006 | van Wonterghem et al. | 343/702 |
| 2006/0001578 | A1 | 1/2006 | Holmes et al. | 343/702 |

FOREIGN PATENT DOCUMENTS

| | | |
|---|---|---|
| CA | 2270302 | 10/2000 |
| CA | 2307515 | 10/2000 |
| GB | 2 400 497 | 10/2004 |
| WO | WO 00/59070 | 10/2000 |

OTHER PUBLICATIONS

*Rothammels Antennebuch*, Alois Krischke, SDOCID XP-002487620-2001, chapters 7.3.1, 7.4.2, 7.4.3.1,and 34.3.3.2.

* cited by examiner

*Primary Examiner*—Shih-Chao Chen
(74) *Attorney, Agent, or Firm*—Lawrence J. Shurupoff

(57) ABSTRACT

A multiband antenna system includes a helical antenna having a first leg and a second leg wherein the first leg consists of a coaxial conductor. The multiband antenna also includes an antenna sub-system coupled to the helical antenna wherein the coaxial conductor feeds the antenna sub-system. A radome encloses components of the antenna system, and the radome may be covered by a radio-frequency transparent sock for concealment purposes.

15 Claims, 10 Drawing Sheets

SMALL, NARROW PROFILE MULTIBAND ANTENNA

TECHNICAL FIELD

The present invention is generally directed to multiband antennas. In particular, the present invention is directed to a multiband antenna which is small and provides a narrow profile. Specifically, the present invention is directed to a multiband antenna which provides good isolation properties and is small enough for use with an unmanned ground sensor.

BACKGROUND ART

Currently, unmanned ground sensors are positioned in remote locations. The sensors collect information and data related to weather and ground conditions. And, these ground sensors can detect physical activity such as movement of vehicles, individuals and animals in a defined area. With appropriate antenna systems, these sensors are also capable of transmitting the collected information to a centralized location by transmitting signals to a nearby ground station, overflying aircraft, or even satellites. The antenna system functions as part of the overall sensor to detect the aforementioned movements and nearby electrical communications. It will also be appreciated that these unmanned sensors can be reprogrammed to monitor other characteristics as needed, or the sensors can be turned off remotely if their use is no longer required.

The most effective sensors are believed to be those that are not easily detected. For example, sensors used for military purposes must be inconspicuous and not easily detected. In other words, it is desirable for the sensor and antenna to be small and adaptable to various environmental settings. It is also important for such a sensor and associated antenna to be electrically quiet so as to avoid detection by other sensors.

Skilled artisans will appreciate that these devices must be able to operate in selected frequency ranges and also operate in multiple frequency ranges. Unfortunately, such antennas known in the art can be quite sizeable and easily detected, thereby defeating their purpose. Therefore, there is a need in the art for a multiband antenna to be small, compact, easily concealed, and capable of operating on multiple and select frequency ranges. And there is a need for the sensor and associated antenna to operate in an electrically quiet manner.

SUMMARY OF THE INVENTION

In light of the foregoing, it is a first aspect of the present invention to provide a small, narrow profile multiband antenna.

It is another aspect of the present invention to provide a multiband antenna system comprising a helical antenna having a first leg and a second leg, wherein the first leg comprises a coaxial conductor, and at least one antenna sub-system coupled to the helical antenna, wherein the coaxial conductor feeds the at least one antenna sub-system.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
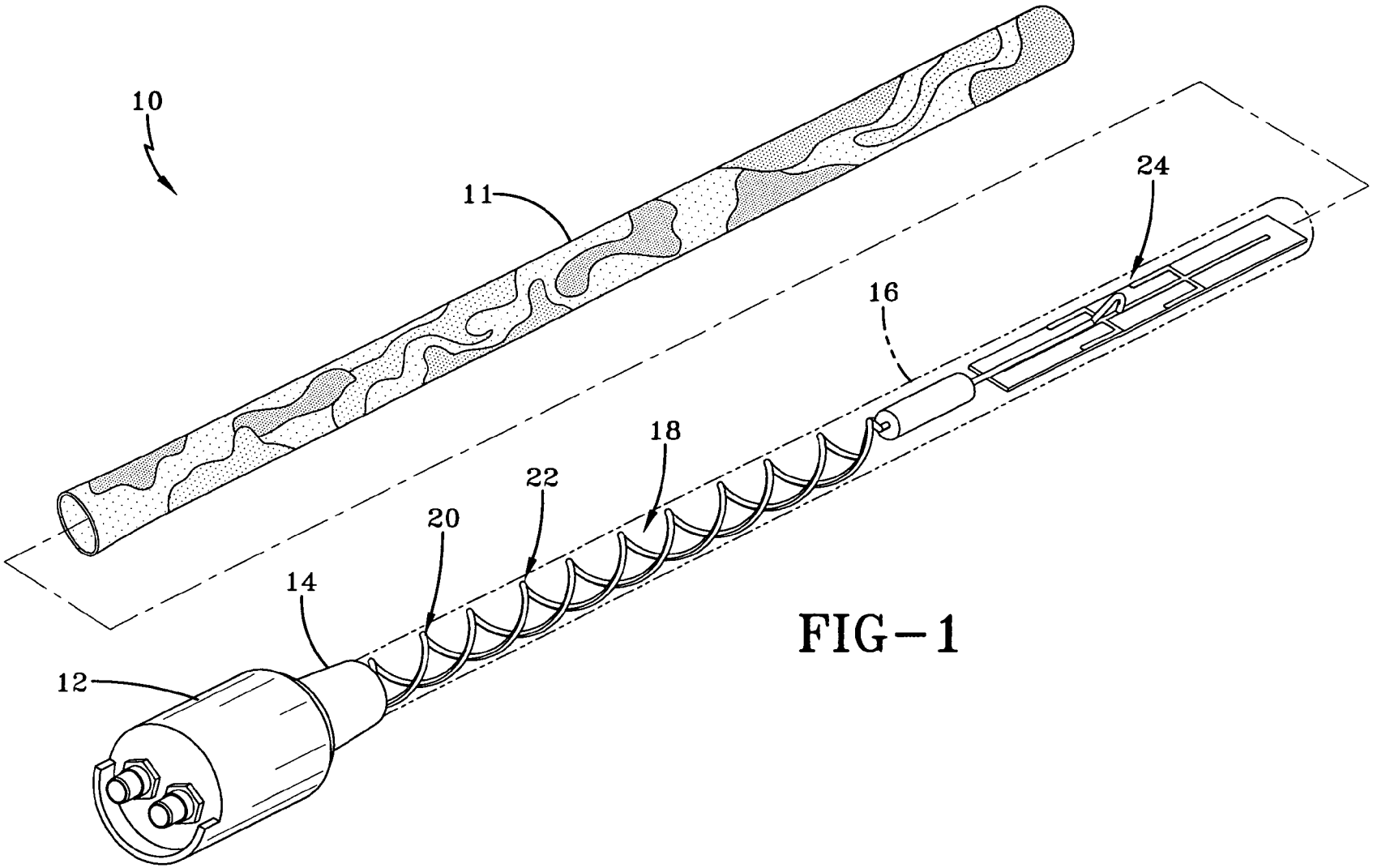
FIG. 1 is a perspective view of a multiband antenna according to the concepts of the present invention.
Figure 2:
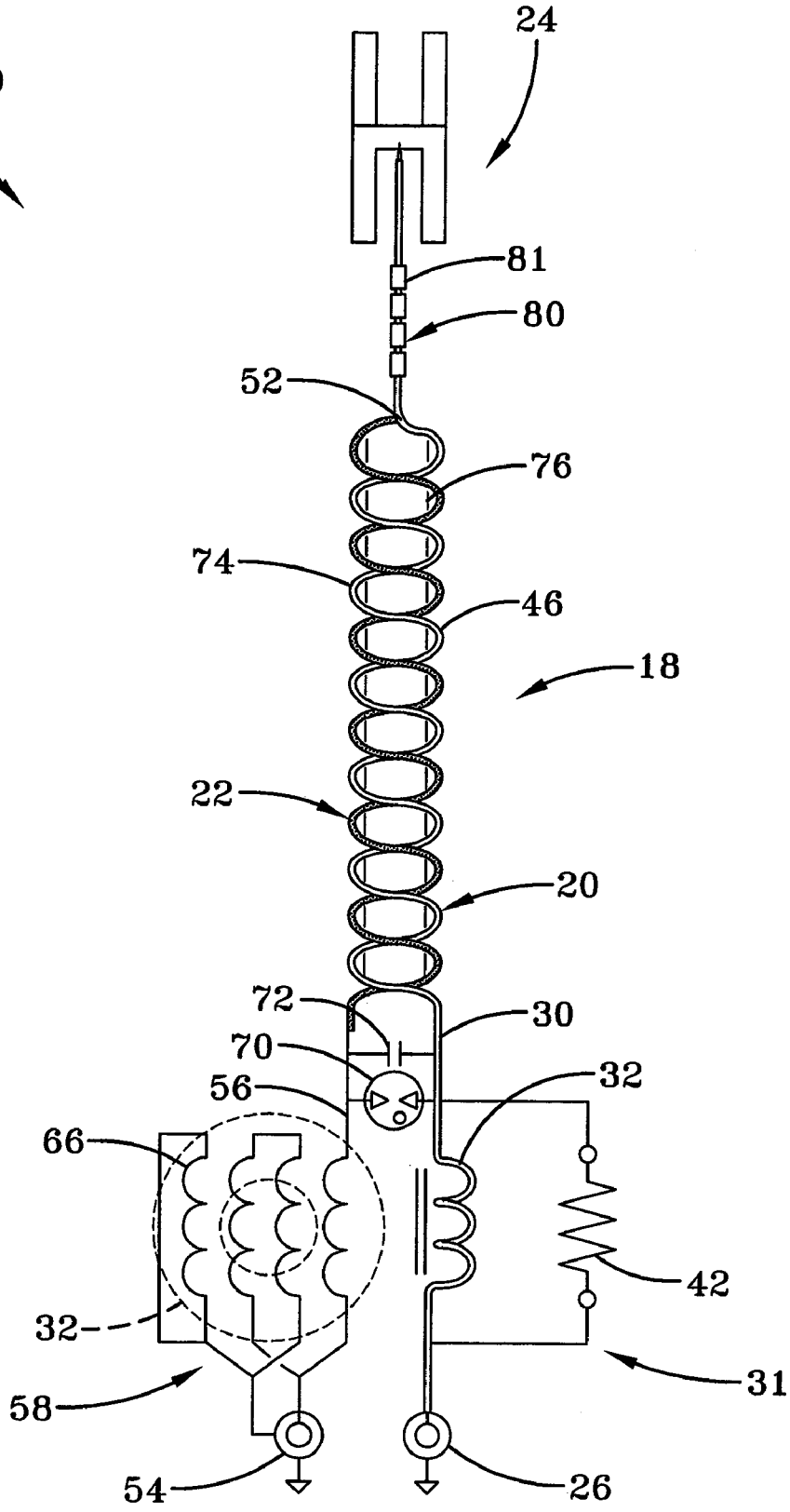
FIG. 2 is an electrical schematic diagram of the multiband antenna according to the concepts of the present invention.

Referring now to the drawings, and particularly to FIGS. 1 and 2, it can be seen that a multiband antenna system according to the concepts of the present invention is designated generally by the numeral 10. The antenna system may be used with ground sensors, other types of sensors, or any other device that requires the transmission and the reception of wireless signals. As will become apparent as the description proceeds, the antenna system 10 is constructed in such a manner so as to provide a relatively small and narrow profile so that the antenna system is not easily detected. Indeed, the antenna system can be constructed in such a manner to blend with the terrain in which the associated sensor is to be located. For example, the antenna system 10 can be provided with brown/green coloring so as to allow it to be placed in fields, or the antenna system 10 can be constructed to match rock textures in a selected region. To allow a rapid change of the type of camouflage, a radio frequency transparent sock 11 can be supplied with the antenna to allow the user to choose what is most appropriate for the mission. The sock 11 can simply be slipped over the installed antenna during deployment.

The antenna system 10 includes a base 12 from which may extend a strain relief 14 that is carried by the base. The base 12 is secured to the sensor or other device in a manner understood in the art. A radome 16 may be retained within the strain relief, if provided, and connected to and carried by the base 12. As is well understood, the base 12 and radome 16 provide an outer covering for the antenna system components. The radome 16 may be appropriately camouflaged, or the appropriate aforementioned sock could be used. Indeed, the sock 11 form fits over the radome 16 and is secured to the base and/or strain relief in any conventional manner such as with an elastic band, hook and loop fasteners, and the like. And the sock can be appropriately colored. For example, a white sock could be used for snowy areas, tan for desert areas, and so on. The sock 11 could also incorporate camouflage patterns as shown in FIG. 1. The sock 11 may be made from nylon or any other form-fitting material. Moreover, the sock could be reversible so as to provide for an easy change to the type of camouflage.

The antenna system 10 includes a helical antenna which operates in a first range of frequencies. As will be described in detail later, the helical antenna 18 includes a first leg 20 and a second leg 22. Coupled to and associated with the helical antenna 18 is an antenna sub-system 24 which operates in a different frequency range. In the present embodiment the frequency range of sub-system 24 is C-band. However, the skilled artisan will appreciate that any frequency band antenna could be associated with the helical antenna 18 in view of its attributes to be described.

Figure 3:
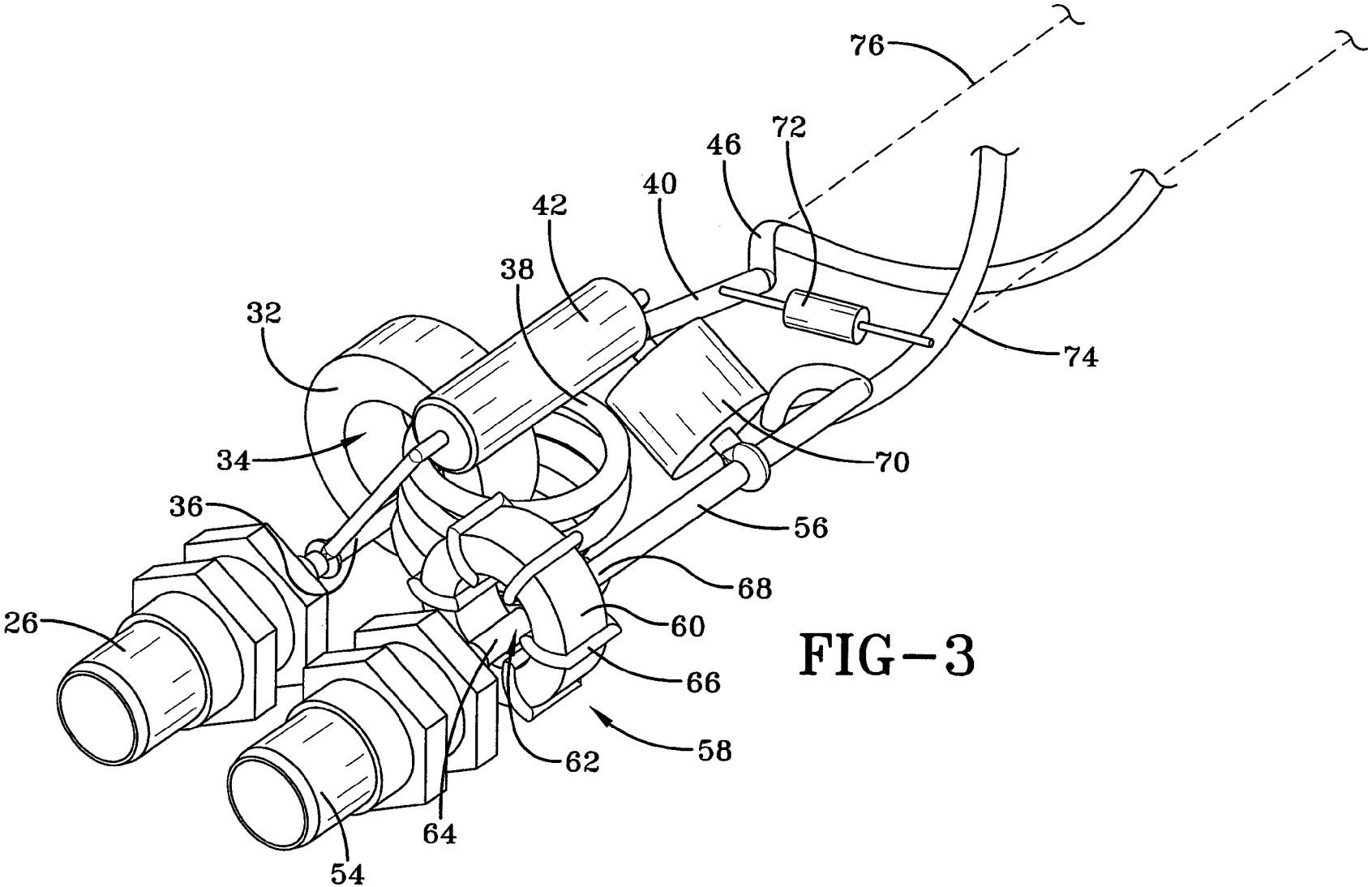
FIG. 3 is a partial perspective view of selected components of the antenna according to the present invention.
Figure 4:
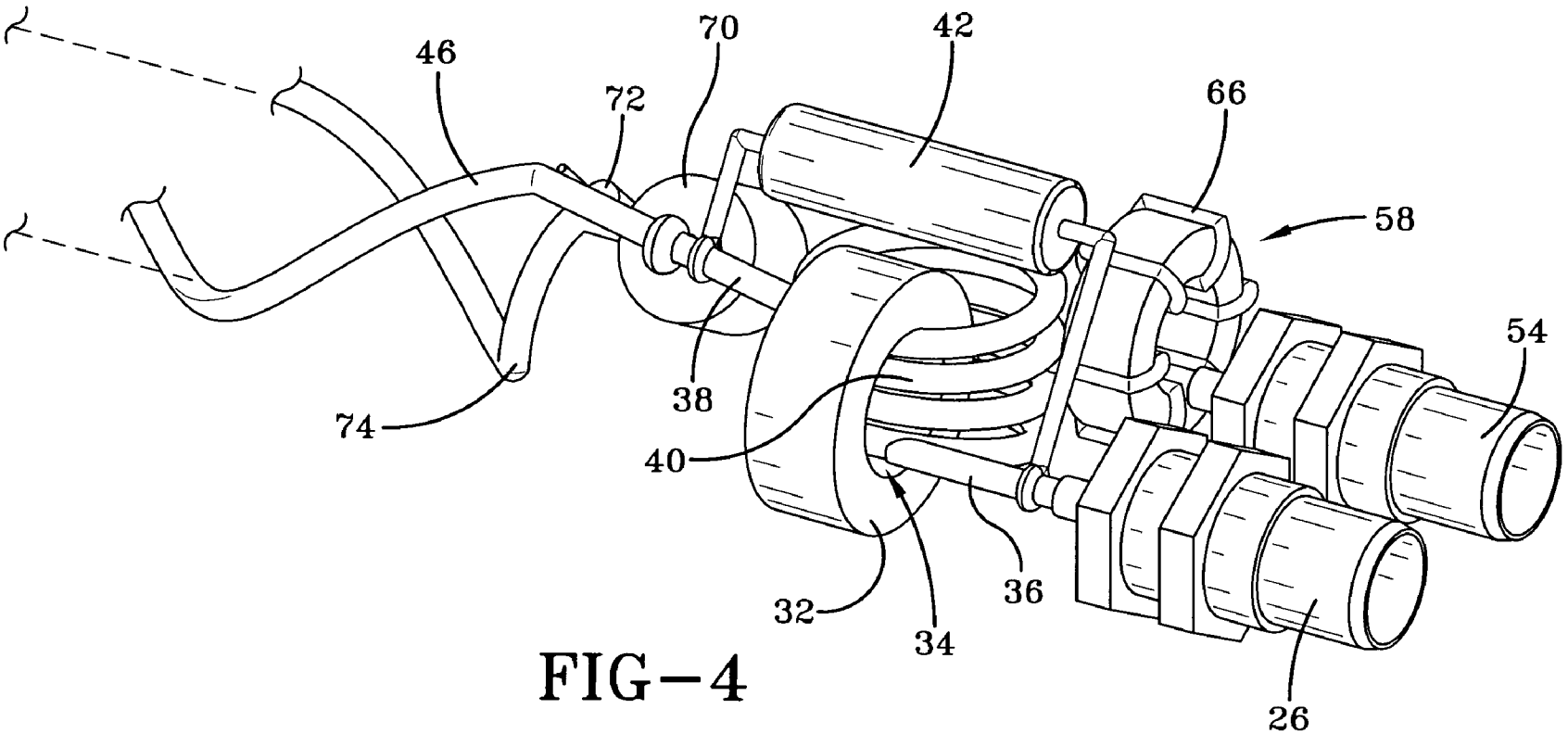
FIG. 4 is another partial perspective view of selected components of the antenna.

The base 12 provides a connector 26 which is mountable to the appropriate transmitting/receiving equipment associated with the aforementioned sensor. Helical antenna 18 is connected to the connector 26 as best seen in FIG. 2 and as specifically shown in FIGS. 3 and 4.

The first leg 20 comprises a coaxial cable designated generally by the numeral 30. The cable 30 includes a center conductor which is surrounded by an insulation material and an outer shield conductor. In the present embodiment, the coaxial cable 30 is in the form of a conformable coaxial cable. In other words, the outer shield conductor is flexible, but somewhat rigid so that it can be deformed into a desired shape and retain that shape in most any circumstance. A core made of plastic and electrically transparent to RF (Radio Frequency energy), with helical grooves and radius appropriate to the desired design can be used to form this conformable coaxial cable. As will be discussed, the core also carries the second leg 22 in an appropriate manner.

An isolation network 31 is associated with the first leg. The network 31 is configured such that the coaxial cable 30 is inserted through and wrapped around a toroid 32. Specifically, the toroid 32 is made of a ferrite material and provides an opening 34 therethrough. The coaxial cable has an entry end 36 which is received within the opening 34 and forms loops, designated generally by the numeral 38, around the toroid 32 any number of times, which in the present embodiment is four times, and exits the opening at a coax end 40. The number of loops 38 for the coaxial cable to be wrapped around the toroid can be of any number to provide the necessary electrical isolation. In conjunction with the number of loops of the cable around the toroid, a resistor 42 is connected across the entry coax end 36 and the exit coax end 40. The combination of the resistor and the toroid effectively function to terminate the first leg in the network 31 that appears to this portion of the antenna to be resistive. The value of this resistance is chosen to complement the terminal impedance over band-width to allow a low voltage standing wave ratio (VSWR) for the helical antenna.

The second leg 22 is formed from a single conductor and is connected to connector 54 that is carried by the base 12. In this embodiment, the wire 56 is a solid wire and is connected to a transmission line transformer designated generally by the numeral 58. Although any type of transmission line transformer can be utilized, in the present embodiment it is a 4:1 transmission line transformer. The transformer is of the "Transmission-Line" type of which is even further defined as being of the Guanella type per Transmission Line Transformers . This is not the typical flux coupled transformer but of the type of which windings are actually transmission line whose impedance is the geometric mean of the input and output impedances. Transmission line transformer 58 comprises a toroid 60 which provides a winding form 62. The wire 56 has an entry end 64 and a loop configuration 66, best seen in FIG. 2, which exits at a wire exit end 68. The wire is wrapped or wound in a helical configuration per winding schematic and core outline in FIG. 1. Prior to the helical windings of the first leg 20 and the second leg 22, it can be seen that a gas discharge tube 70 is connected across the wire 56 and the outer shield of the coaxial cable 30. A capacitor 72 is also connected across the wire and the coaxial cable in a similar manner so as to electrically isolate the gas discharge tube. The gas discharge tube is utilized to protect the transceiver equipment from lightening strikes or other large electro-magnetic events.

After the connections to the gas discharge tube and the capacitor, the wire 56 and the coaxial cable 30 are formed into corresponding helixes and the wire is formed into a wire helix 74 which is substantially opposite a helix 46 formed by the coaxial cable. The wire and the coax helixes are positioned so as to be on opposite sides of the radome. A plastic core, designated generally by the numeral 76, may be provided to maintain the desired spacing between the wire helix and the coax helix. Indeed, the core 76 provides an appropriate diameter, pitch and material to properly separate the coaxial cable from the wire and provides the spacing necessary to obtain the desired operational bandwidth of the helical antenna 18. The core 76 is constructed of a polymeric material such as polycarbonate or other low loss and RF transparent material. At the end of the helical antenna 18, distal the connectors 26 and 54, the wire 56 is electrically and mechanically connected to the coaxial cable 30 and in particular to the coax outer shield 78 at a juncture 52. In the present embodiment, by selectively configuring the components of the helical antenna, it can operate over a frequency band of about 225 to about 450 MHz.

The helical antenna 18 is arranged such that it is an electrically shorted, normal mode bi-filar antenna. In this configuration, the first leg 20 is a small coaxial cable that acts as a signal path for another sub-antenna, which is the antenna sub-system 24, that operates on another frequency range or band. As will be appreciated as the description proceeds, this allows for multiple tactical communications and control links to be established with the unmanned ground sensor. Use of a helical antenna allows for operation of a wide band frequency while providing a small package. Moreover, it is believed the helical antenna differs from known prior art assemblies in that it is electrically shorted on one end, and one leg is terminated in a resistor network that allows for wide band operation and transmitter matching.

As best seen in FIGS. 2 and 5-7, it can be seen that the antenna sub-system is designated generally by the numeral 24. Although any type of antenna configuration could be used, it will be appreciated that the present embodiment provides a double-dipole antenna with an integral choke. The sub-system comprises a circuit board 90 which is isolated from the helical antenna by a choke isolation system 80. In this embodiment, the system 80 comprises at least one, and if needed a plurality of, ferrite beads 81. In other words, after the juncture 52, the coaxial cable is directed through openings in the ferrite beads 81 which function to electrically isolate the helical antenna from the antenna sub-system 24. Of course, the system 80 may comprise other types of isolation devices.

Figures 5, 6:
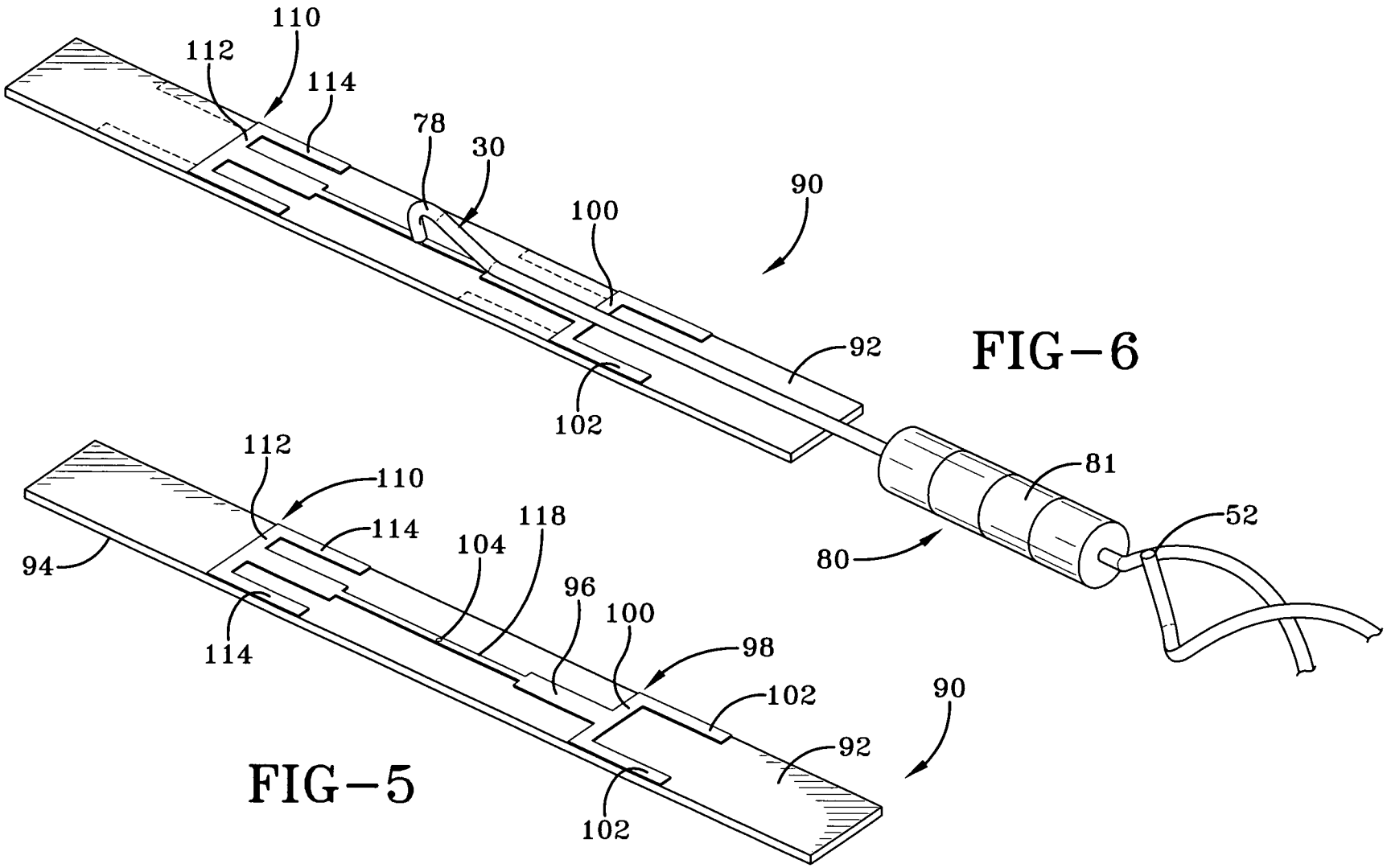
FIG. 5 is a top perspective view of a printed circuit board used in the multiband antenna according to the concepts of the present invention.
FIG. 6 is a partial top perspective view of the antenna showing the printed circuit board with a coaxial cable connected thereto.

The antenna sub-system 24 includes a circuit board 90 which allows for connections to the coaxial cable 30 and, in particular, an outer shield conductor 78 and a center coaxial conductor 91. The circuit board 90 provides a substrate 92 which supports both a "grounded coaxial-shield" side 92 and a "hot coaxial center-conductor" side 94 of the overall antenna artwork. The grounded-side 92 of the printed circuit board provides a shield connection point for the feed line 96. The center conductor of the coaxial cable is connected to the feed line 96 as best seen in FIG. 6. The center conductor acts as an excitation probe to energize the hot and grounded sides of the artwork which form a planar-transmission line. This planar feed line 96 is connected to a first dipole 98 which provides dipole arms 100 which are substantially perpendicular to the feed line 96. Arm extensions 102 extend substantially perpendicularly from the arms 100 and are substantially parallel with the feed line 96. These extensions 102 extend back toward the helical antenna. The feed line 96 continues beyond the first dipole 98 and a tap point 104 is provided above the dipole arms 100 and extends all the way through the circuit board 90. The coaxial outer shield 78 is mechanically and electrically connected to the feed line 96. The center conductor 91 is directed through the tap point 104 and is connected to components on the conductor side 94 of the printed circuit board.

The feed line 96 further extends from the first dipole 98 to a second dipole designated generally by the numeral 110. The dipole 110 includes dipole arms 112 which extend substantially perpendicularly from the feed line 96. And further extending from the dipole arms 112 are arm extensions 114 which are substantially perpendicular to the arms 112 and extend back toward the first dipole and, in particular, the dipole arms 100.

Figure 7:
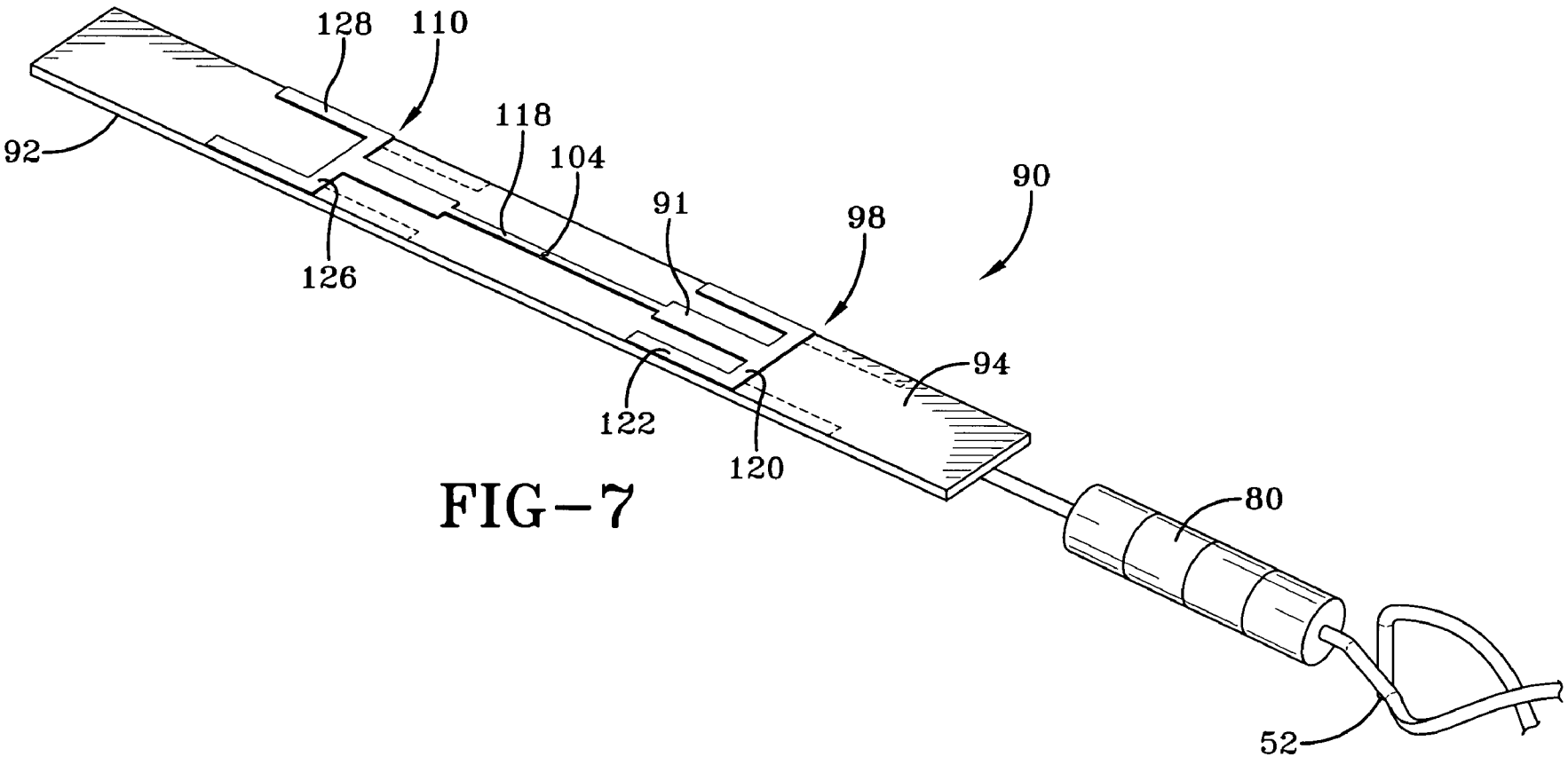
FIG. 7 is a partial bottom perspective view of the printed circuit board and the coaxial cable shown in FIG. 6.

As best seen in FIG. 7, the center conductor is directed through the tap point 104 and is connected to a conductor feed line designated generally by the numeral 118. The first dipole 98 is provided and connected to the conductor feed line 118 by arms 120 which extend substantially perpendicularly therefrom. Extending from the arms 120 are arm extensions 122 which are substantially parallel to the feed line 118 and extend in a direction opposite that of the arm extensions 102 provided on the shield side of the circuit board.

The second dipole 110 includes a pair of arms 126 extending substantially perpendicularly from the feed line 118 and which further extend to arm extensions 128 that are substantially parallel with the feed line 118. Configuration of the arms and arm extensions with respect to the first and second dipoles is such that a double dipole antenna is formed on the circuit board 90. By selectively configuring and sizing the spacing of the dipoles, the desired electrical transmission and operating frequency can be obtained for the antenna sub-system 24.

Although a double dipole antenna is shown, the antenna sub-system 24 may be an array of elements which serve to provide other antenna radiation functions. In other words, the antenna sub-system may comprise a single antenna or an array of antennas. In the present embodiment, the double di-pole configuration operates over a frequency band of about 5.0 GHz to about 6.0 GHz. However, it will be appreciated that any antenna configuration could be associated in view of the helical antenna providing a coaxial antenna as one of the branches of the helix. Such a configuration provides a method of effectively feeding and realizing multi-band operation with good gain, isolation and efficiencies which are normally difficult to achieve with small antenna apertures. This configuration is advantageous in that the antennas can be co-located and/or coaxially positioned within a single narrow radome to create a narrow profile, low visual detection antenna system for a tactically deployed unmanned ground sensor or an entire network of such sensor devices. The present construction is also advantageous in that it provides a covering, such as the sock 11, to help conceal the antenna in different types of environments.

As configured, the antenna sub-system is a C-band antenna which provides uniform azimuth of about 7.5 dBi+/−0.5 dB. The antenna sub-system provides an elevation beam width (3 db) of about 12 degrees and a dipole array length of about 8 centimeters. In the present configuration, the C-band antenna provides a frequency range of about 5.0 to about 6.0 GHz with a VSWR of less than 2.5.

Figure 8:
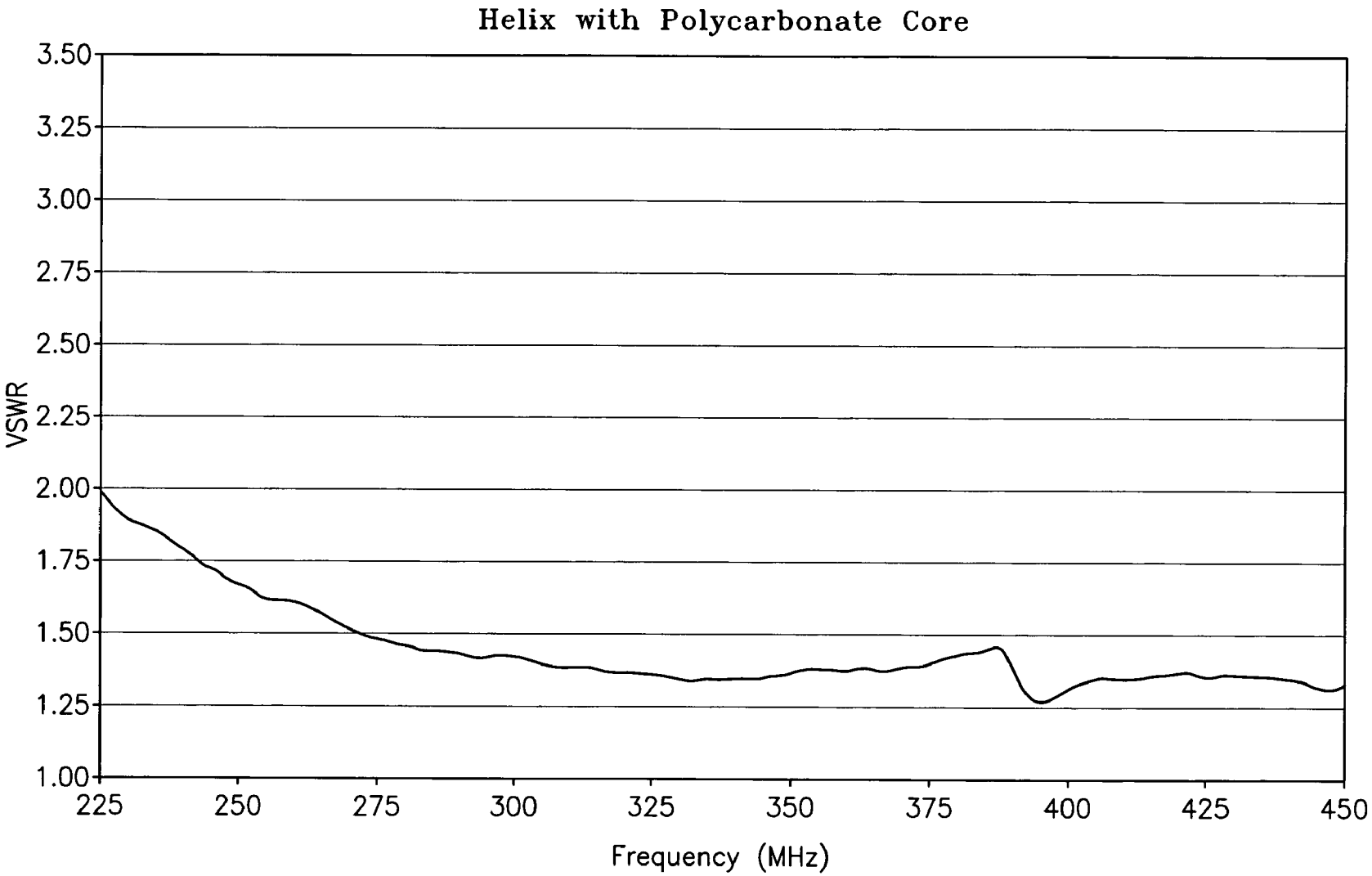
FIG. 8 is a plot of voltage standing wave ratio (VSWR) versus frequency in MHz for a helical antenna which is part of the multiband antenna according to the present invention.
Figure 9:
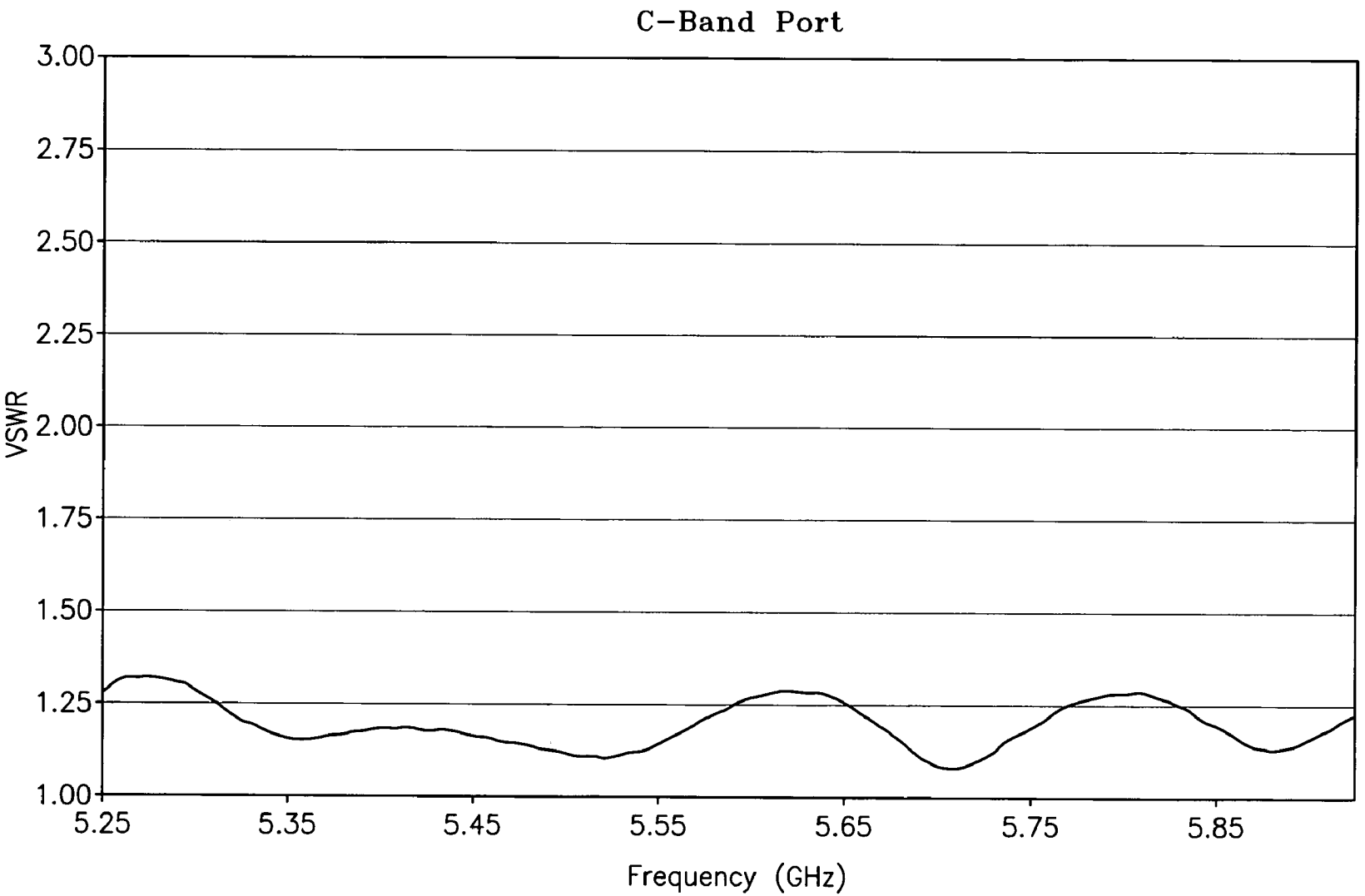
FIG. 9 is a plot of voltage standing wave ratio (VSWR) versus frequency in GHz for an antenna sub-system coupled to the helical antenna according to the concepts of the present invention.
Figure 10:
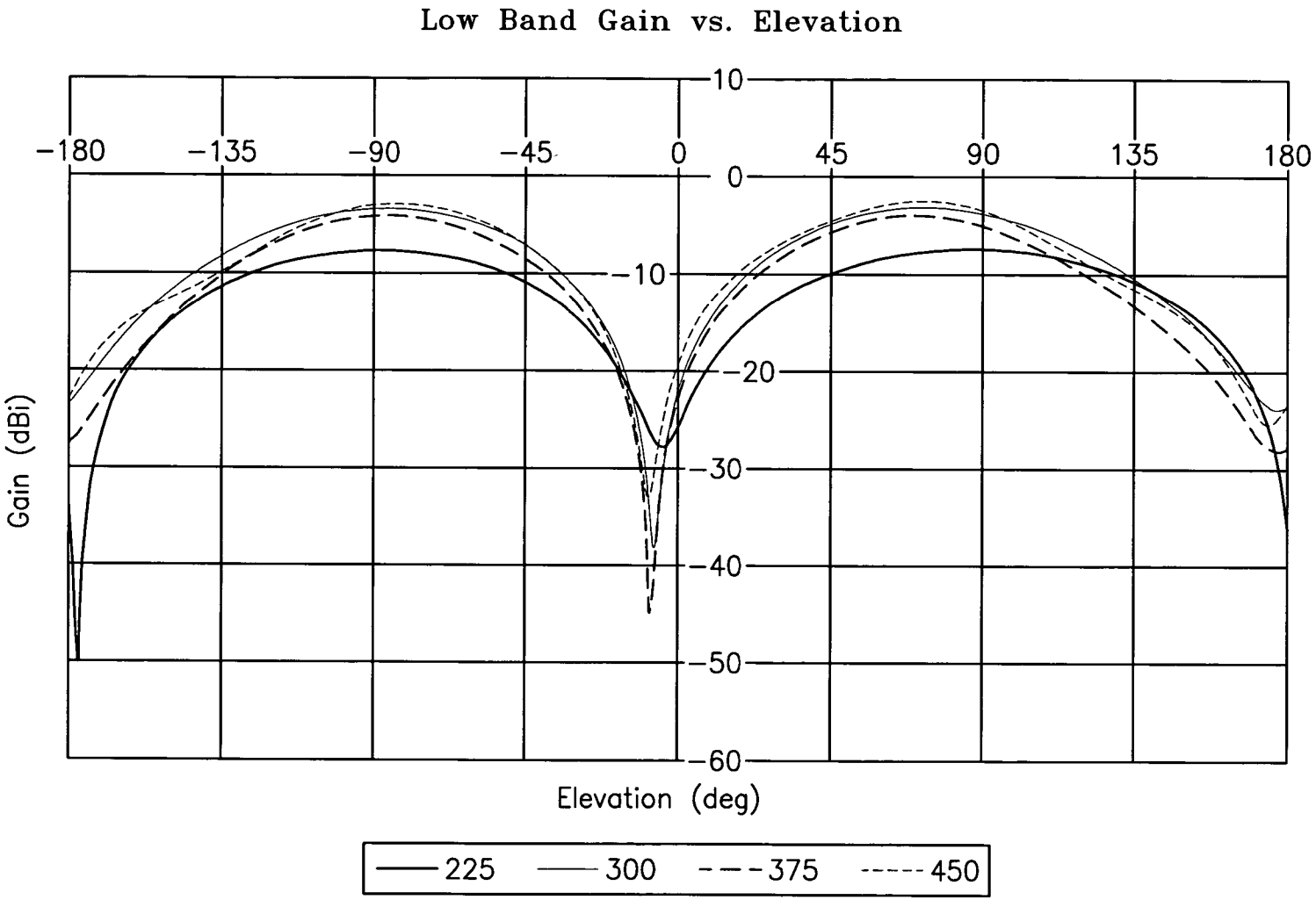
FIG. 10 is a low band gain versus elevation plot for the helical antenna according to the concepts of the present invention.
Figure 11:
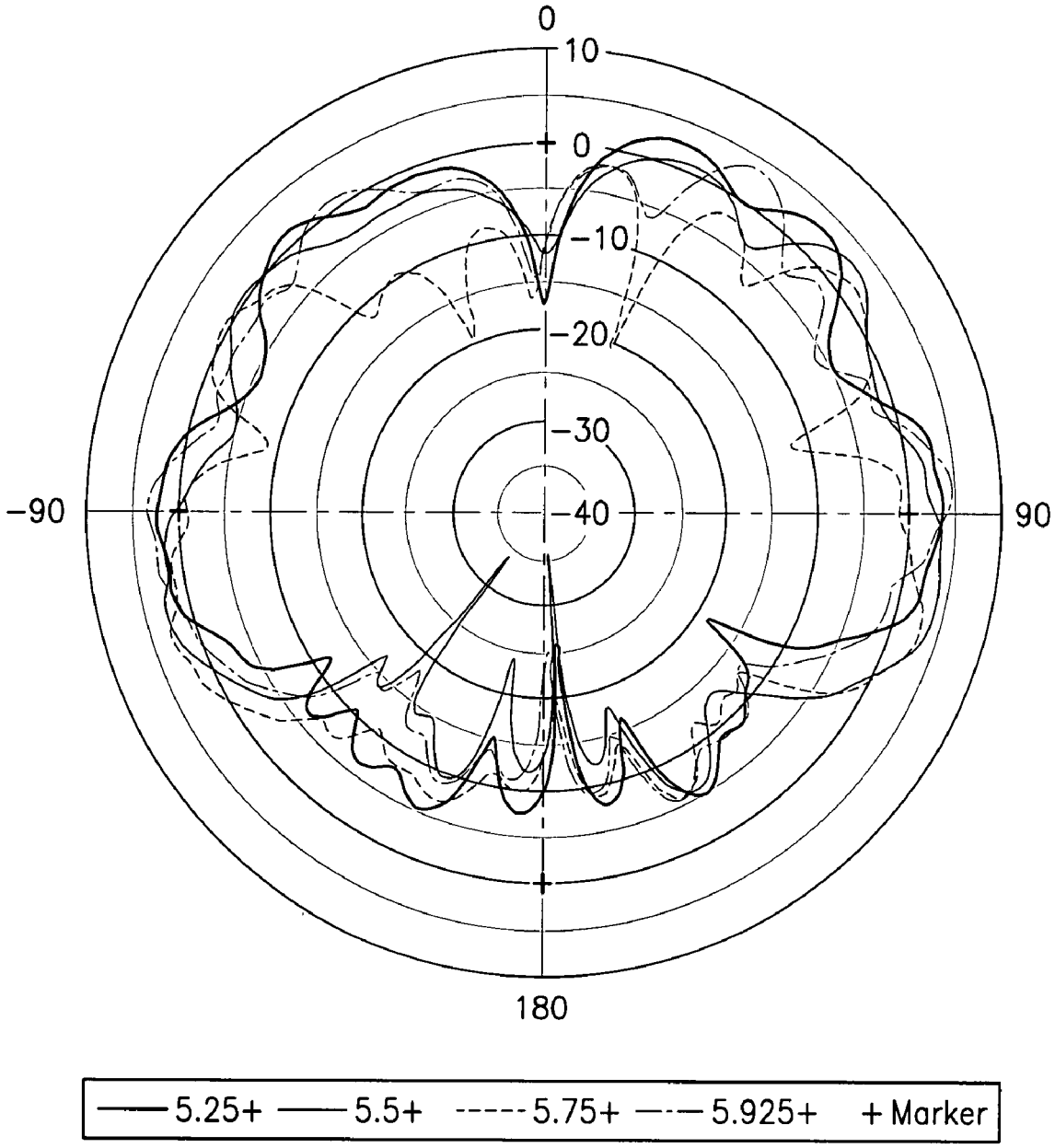
FIG. 11 is an antenna gain elevation pattern for the antenna sub-system according to the concepts of the present invention.

Referring now to FIGS. 8-11, it can be seen that plots of calculated measurements for an antenna configuration utilizing the components described herein provide a helical antenna with a VSWR versus frequency (MHz) plot as shown in FIG. 8. A similar plot for the antenna sub-system is shown in FIG. 9 wherein the VSWR is less than 1.5 over the selected range of frequency. A low band gain versus elevation plot is provided for the helical antenna in FIG. 10 and an antenna gain elevation pattern for the antenna sub-system 24 is provided in FIG. 11. It will be appreciated that these plots are approximations based upon software modeling of the electrical characteristics of the antenna presented herein.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A multiband antenna system comprising:

an electrically shorted bi-filar helical antenna having a first leg and a second leg, wherein said first leg comprises a coaxial conductor formed into a helix; and at least one antenna sub-system coupled to said helical antenna, wherein said coaxial conductor feeds said at least one antenna sub-system.

2. The system according to claim 1, further comprising:

at least one choke isolation system interposed between said helical antenna and said at least one antenna sub-system.

3. The system according to claim 2, wherein said at least one choke system comprises at least one ferrite bead that receives said coaxial conductor.

4. The system according to claim 1, wherein said coaxial conductor has an insulated center conductor surrounded by an outer shield, and wherein said second leg is a wire formed into a helix and connected to said outer shield at a distal end of said helical antenna.

5. The system according to claim 4, further comprising:

a transmission line transformer connected to said wire at a proximal end of said helical antenna.

6. The system according to claim 5, further comprising:

an isolation network connected to said coaxial conductor at a proximal end of said helical antenna.

7. The system according to claim 6, wherein said isolation network comprises:

a toroid having an entry end of said coaxial conductor received in and looped around said toroid, and an exit end of said coaxial conductor exiting from said toroid; and a resistor connected to said entry end and said exit end across said toroid.

8. The system according to claim 6, further comprising:

a gas discharge tube connected between said first leg and said second leg; and a capacitor connected between said first leg and said second leg.

9. The system according to claim 1, further comprising:

a core having an appropriate diameter and pitch to carry said first leg and said second leg in a desired spaced apart relationship.

10. The system according to claim 9, wherein said second leg comprises a wire conductor.

11. The system according to claim 1, wherein said antenna sub-system comprises:

at least one dipole antenna.

12. The system according to claim 1, wherein said antenna sub-system comprises:

a circuit board having a shield side and a conductor side, and a tap point extending therethrough, said coaxial conductor having an insulated conductor surrounded by a shield conductor, said insulated conductor extending through said tap point and connected to an arm of at least one dipole on said conductor side and said shield conductor connected to another arm of said at least one dipole on said shield side, wherein said antenna operates around 6000 MHz.

13. The system according to claim 1, further comprising:

a base; and a radome extending from said base and enclosing said helical antenna and said at least one antenna sub-system.

14. The system according to claim 13, further comprising:

a radio-frequency transparent sock disposed over said radome.

15. The system according to claim 14, wherein said sock is adapted to match a surrounding terrain.

* * * * *